US006061972A

United States Patent [19]

Thorp

[11] Patent Number: 6,061,972

[45] Date of Patent: May 16, 2000

[54] LIGHTWEIGHT FREESTANDING DIVIDER WALL

[75] Inventor: Clarkson S. Thorp, Wayland, Mich.

[73] Assignee: Haworth, Inc., Holland, Mich.

[21] Appl. No.: 09/083,231

[22] Filed: May 21, 1998

[51] Int. Cl.[7] ..... G09F 15/00

[52] U.S. Cl. ..... 52/36.1; 52/309.4; 52/283; 52/239; 52/243; 160/351; 248/188.8; 40/606

[58] Field of Search ..... 52/36.1, 36.5, 52/64, 309.4, 283, 236.2, 239, 243; 160/135, 351, 352; 248/684, 688, 188.8; 40/605, 606

[56] References Cited

U.S. PATENT DOCUMENTS

| | | | |
|---|---|---|---|
| D. 127,928 | 6/1941 | Wellman | 160/135 X |
| 1,386,469 | 8/1921 | Gomoll | 248/473 |
| 2,345,913 | 4/1944 | Bishop | 160/351 X |
| 3,164,356 | 1/1965 | Zajaczkowski | 248/684 |
| 3,927,481 | 12/1975 | Safranek | 160/130 X |
| 3,940,100 | 2/1976 | Haug | 248/188.1 |
| 4,118,903 | 10/1978 | Coulthard | 160/351 X |
| 4,200,254 | 4/1980 | Nelson | 52/239 X |
| 4,574,917 | 3/1986 | Stoddard | 182/151 |
| 4,635,417 | 1/1987 | Larouche | 52/239 |
| 5,031,683 | 7/1991 | Marvy et al. | 160/351 |
| 5,318,150 | 6/1994 | Donaho | 248/188.8 X |
| 5,771,954 | 6/1998 | Benner et al. | 160/351 X |

*Primary Examiner*—Beth A. Aubrey
*Assistant Examiner*—Brian E. Glessner
*Attorney, Agent, or Firm*—Flynn, Thiel, Boutell & Tanis, P.C.

[57] ABSTRACT

A portable divider wall including a wall member of a lightweight foam material and two foot supports or feet located along a bottom portion of the wall member for supporting the wall member in an upright position. The foot supports each include a recess in which the bottom portion of the wall member is disposed, and a projection which projects into the interior of the wall member to removably secure the foot to support the wall member.

15 Claims, 5 Drawing Sheets

LIGHTWEIGHT FREESTANDING DIVIDER WALL

FIELD OF THE INVENTION

This invention relates to an upright, freestanding, portable divider wall arrangement for use in offices and the like.

BACKGROUND OF THE INVENTION

Upright divider arrangements for use in commercial and office environments are well known and numerous variations of such have been developed. Many known divider arrangements, however, have been developed solely for the purpose of functioning as a privacy divider between adjacent working areas, and accordingly many such arrangements are heavy, bulky, and not readily movable or transportable.

SUMMARY OF THE INVENTION

It is an object of the present invention to provide an upright, freestanding divider wall particularly for use in office and commercial environments which is relatively inexpensive, easy to assemble, lightweight and easily movable. The divider wall according to the invention is also usable for displaying information thereon, and can generally improve the acoustics of a work area.

The upright, freestanding, portable divider wall arrangement of this invention, in a preferred embodiment, includes a wall member of a lightweight rigid foam material having a top portion and a bottom portion, and two feet disposed generally spaced-apart from one another along the bottom portion of the wall member. In addition, each foot includes an arrangement for removably fastening the foot to a part of the bottom portion of the wall member.

The invention also provides a foot support for a divider wall having two surfaces which face away from one another and an interior portion defined therebetween. The foot support includes a generally vertical, top opening recess for receiving therein a bottom portion of a divider wall, wherein the recess is defined by two side walls and a bottom wall extending between the two side walls. The foot support also includes a projection which extends generally vertically upwardly from the bottom wall of the recess for disposal within the interior portion of the divider wall to fixedly fasten the foot support to the divider wall.

Other objects and purposes of the invention will be apparent to persons familiar with structures of this general type upon reading the following specification and inspecting the accompanying drawings.

Figure 1:
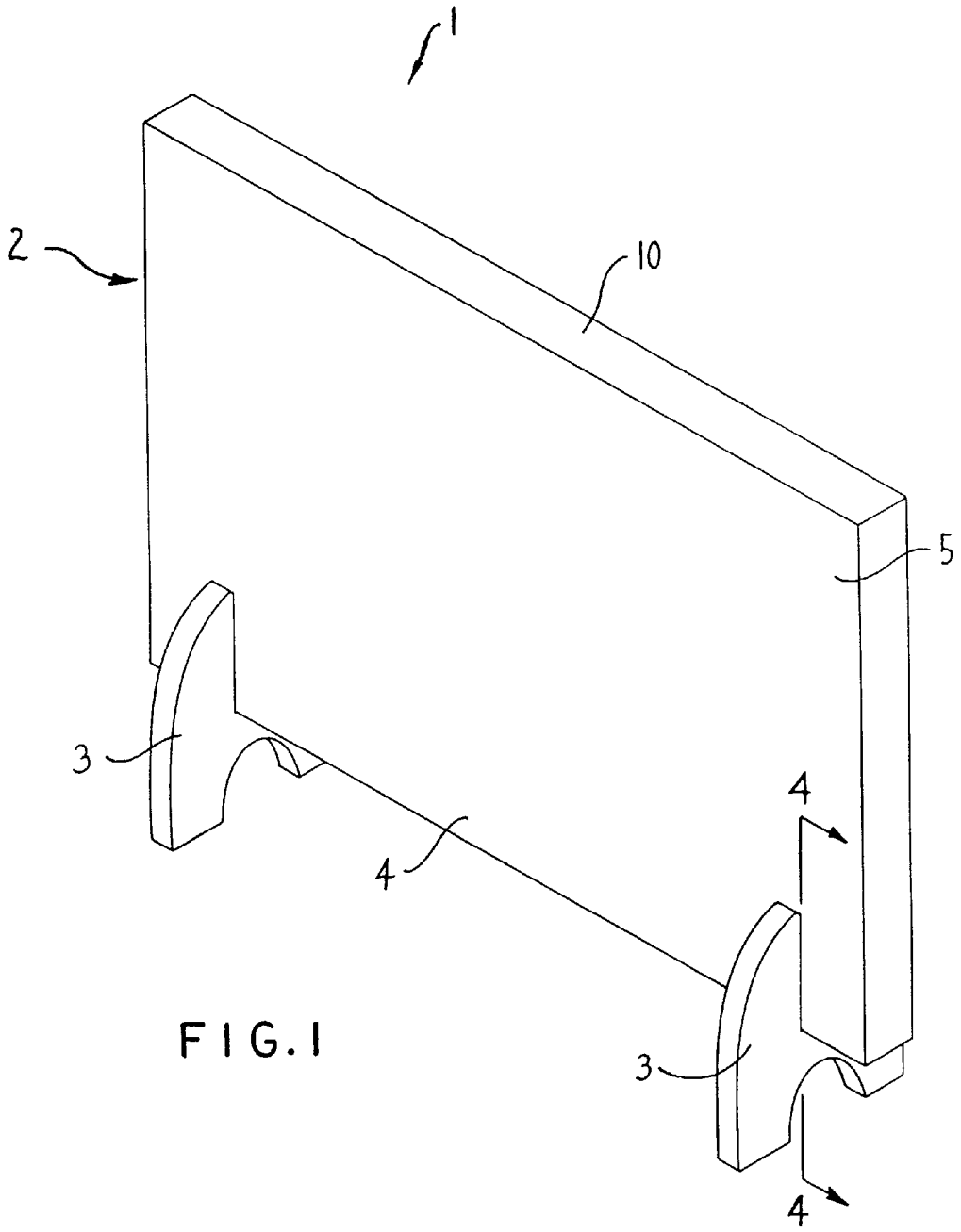
FIG. 1 is a perspective view illustrating a preferred embodiment of the divider wall arrangement according to the present invention.

Certain terminology will be used in the following description for convenience in reference only, and will not be limiting. For example, the words "upwardly", "downwardly", "rightwardly" and "leftwardly" will refer to directions in the drawings to which reference is made. The words "inwardly" and "outwardly" will refer to directions toward and away from, respectively, the geometric center of the apparatus and designated parts thereof. Said terminology will include the words specifically mentioned, derivatives thereof, and words of similar import.

DETAILED DESCRIPTION

Referring to FIGS. 1–4, there is illustrated an upright divider wall 1 in accordance with the present invention. The divider wall includes a wall member 2 and two identical foot supports or feet 3 located along a bottom portion 4 of the wall member 2 generally adjacent opposite ends thereof.

The wall member 2 is preferably constructed of a lightweight, rigid foam material, such as Styrofoam®, and according to a preferred embodiment of the invention, has two generally parallel and planar end surfaces 5 and 6 (FIGS. 1 and 4) and a peripheral edge 10 which together provide the wall member 2 with a generally rectangular plate or slab-like shape. It should be understood that it would be within the scope of the present invention to provide the wall member 2 with other than a rectangular shape, one example of which is discussed below with reference to FIG. 5.

Figure 2:
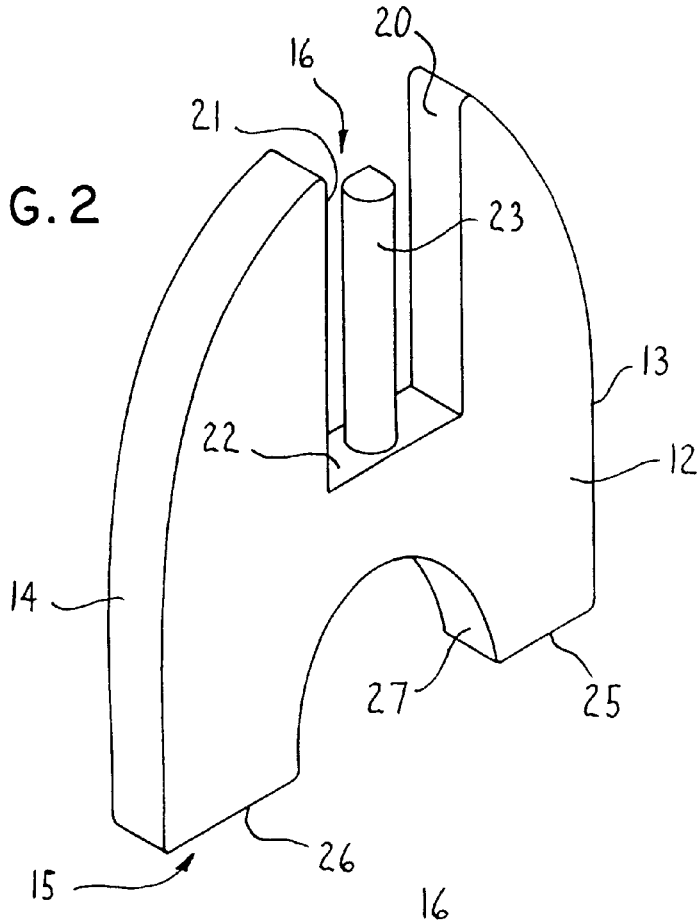
FIG. 2 is an enlarged perspective view of a foot support thereof.
Figure 3:
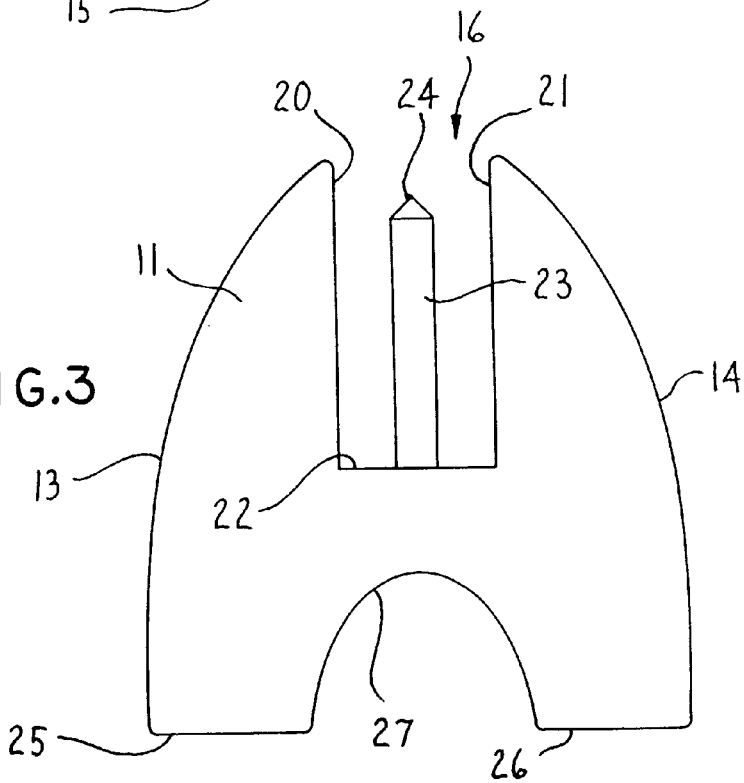
FIG. 3 is an enlarged frontal view of the foot support, the rear view being a mirror image thereof.

As the feet 3 are identical to one another, only one such foot 3 will be described. With reference to FIGS. 2 and 3, the foot 3 preferably includes two oppositely disposed parallel and planar end surfaces 11 and 12 adjoined to one another by two side edge surfaces 13 and 14 and a bottom edge surface 15 which together form the outer periphery of the foot 3. The foot 3 also includes an upwardly opening recess 16 defined by two facing parallel side walls 20 and 21 and a bottom wall 22 which extends perpendicularly between the side walls 20 and 21.

A preferably cylindrical and cantilevered projection 23 extends generally vertically upwardly from the bottom wall 22 of the recess 16 between the side walls 20 and 21 at approximately equal distances therefrom. The top end 24 of the projection 23 preferably has a pointed shape. The projection 23 may be formed integrally with the foot 3, such as by molding, or may be separate therefrom and fixedly attached thereto for example with adhesive, screws, or other suitable fasteners. The projection 23 and recess 16 function as a fastening structure for supportively engaging the wall member as described hereinafter.

The side edge surfaces 13 and 14 of the foot 3 are preferably rounded, and the bottom edge surface 15 preferably includes two flat portions 25 and 26 which are configured to engage with a generally flat and horizontal support surface such as a floor. A downwardly opening, generally semi-circular recess 27 is located centrally between the flat portions 25 and 26. It will be understood that other configurations of the foot 3 would be within the scope of the invention, for example, side edge surfaces 13 and 14 and bottom edge surface 15 can be configured as straight edges or otherwise.

The foot 3 and projection 23 may be constructed of plastic, wood, or other suitable materials.

The divider wall 1 is preferably of a size sufficient to divide workstations from one another, and may for example, have a height of approximately 5 to 6 feet and virtually any desired length. With wall members 2 having a relatively long length, additional feet 3 may be desired to provide additional stability. The thickness of the wall member 2 is a minimum of about 3 inches, and preferably is about 4 to 6 inches, and the width of the recess 16 in the foot 3 is sized so as to snugly accommodate the thickness of the wall member therein.

Figure 4:
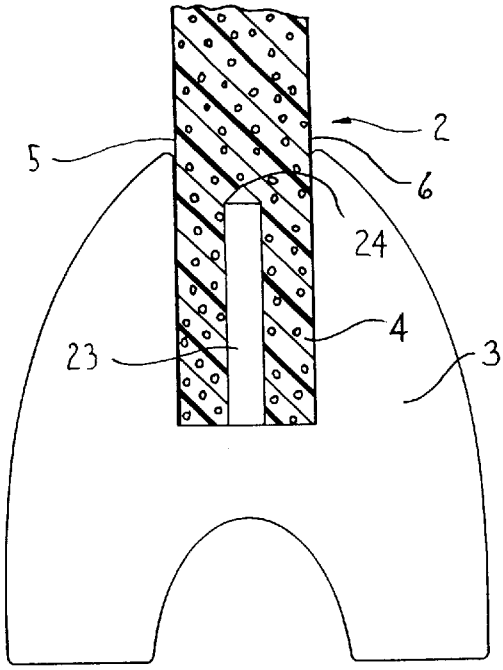
FIG. 4 is an enlarged, fragmented, cross-sectional view taken substantially along line 4—4 of FIG. 1.

The divider wall 1 of the invention may preferably be assembled as follows. The feet 3 are placed upright on a support surface such as a floor and the bottom portion 4 of the wall member 2 is positioned over the feet 3 in a generally perpendicular manner with respect thereto. The wall member 2 is then fitted into the recess 16 of each foot 3 and pressed downwardly to insert the projection 23 thereof into the interior of the wall member 2 through the lower edge surface thereof. The wall member 2 is pressed downwardly until the lower edge surface thereof comes into contact with the bottom wall 22 of each recess 16. Due to the central location of the projection 23 with respect to the side walls 20 and 21 of recess 16, the projection 23 will be located at approximately equal distances from the end surfaces 5 and 6 of the wall member 2 (FIG. 4). For ease in assembly, it may be desirable to bore two starter holes in the lower edge surface of the wall member 2 to guide the projections 23 into the interior of the wall member 2 during assembly. Once assembled, the end surfaces 5 and 6 of the wall member 2 contact the side walls 20 and 21 of the recess 16. Disassembly of the divider wall 1 occurs in the reverse sequence.

Once assembled, the divider wall 1 may be utilized to separate workstations in an office environment and therefore to provide privacy to the individual working thereat. The foam construction of the wall member 2 also provides acoustic (i.e. sound adsorbing) advantages, and the various exposed outer surfaces of the wall member 2 may be utilized to display messages or other information thereon by means of appropriate fasteners, such as tacks. The surface of the wall member also allows self-stick notes, such as POST-IT® notes to be adhered thereto. The light weight of the divider wall enables it to be easily moved about.

Figure 4A:
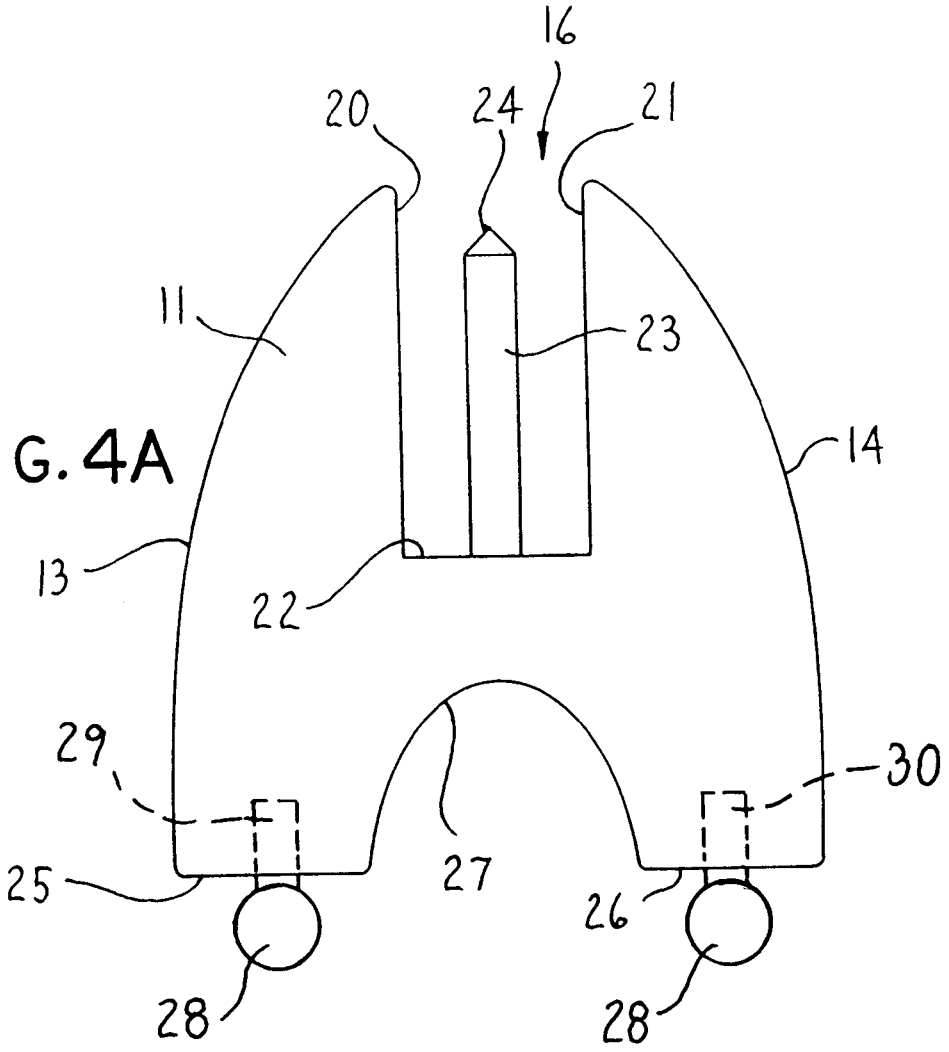
FIG. 4A is an enlarged frontal view showing a variation of the foot support, the rear view being a mirror image thereof.

FIG. 4A shows an alternative embodiment of the foot which includes two wheels or castors 28 which provide the divider wall of the invention with even greater mobility. Each wheel 28 is preferably mounted on the foot by means of a blind bore 29, 30 extending into the foot from each flat portion 25 and 26, respectively. The embodiment of FIG. 4A in other respects corresponds to the embodiment of FIGS. 1–4.

Figure 5:
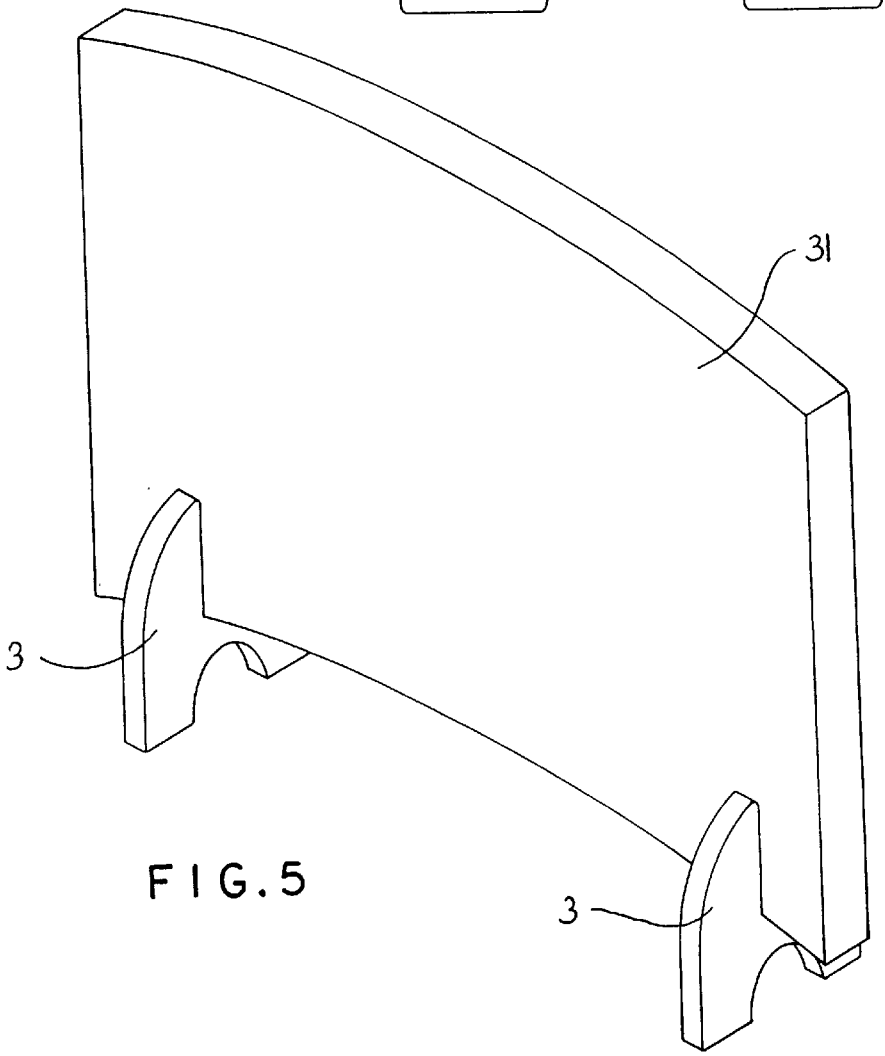
FIG. 5 is a perspective view similar to FIG. 1 but showing a variation of the divider wall arrangement.

FIG. 5 shows an alternative embodiment of a wall member 31 having a generally curved or rounded configuration, and other shapes are within the scope of the present invention. The embodiment of FIG. 5 in other respects corresponds to the embodiment of FIGS. 1–4.

Figure 6:
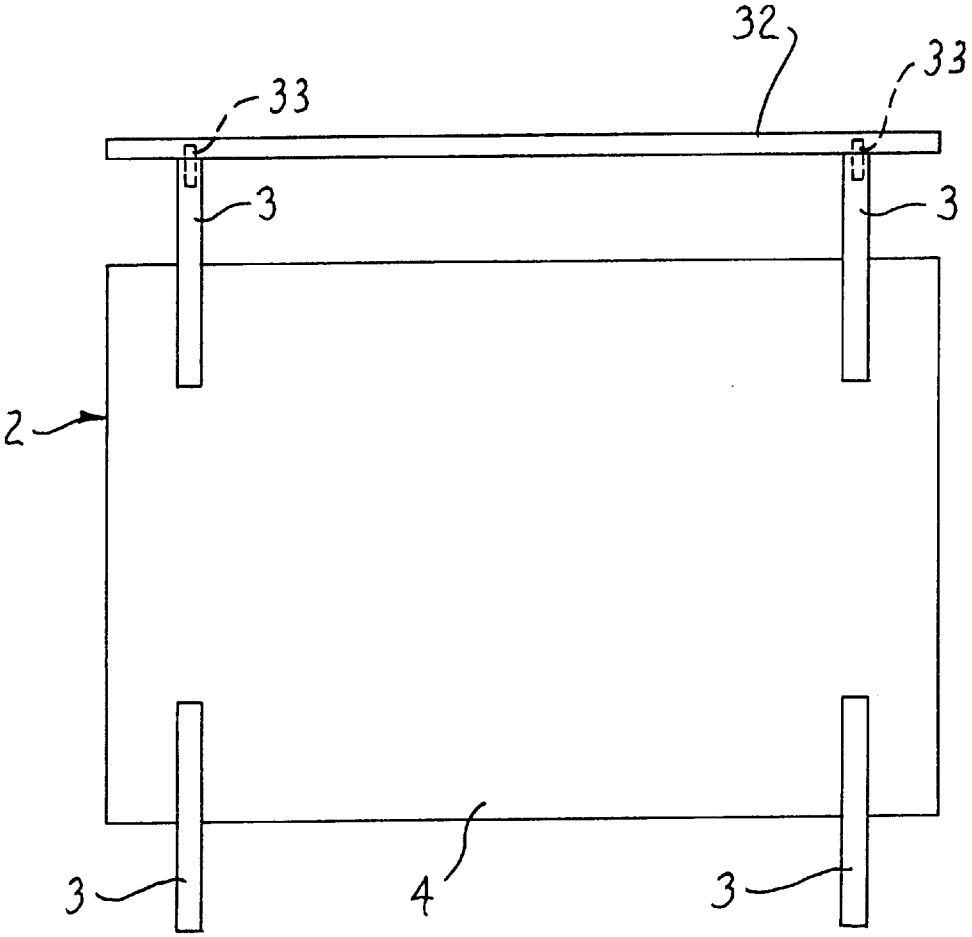
FIG. 6 is a side view of an additional variation of the divider wall arrangement.

FIG. 6 shows an alternative embodiment of the divider wall arrangement which is identical to the embodiment depicted in FIGS. 1–4, except that additional feet 3 are mounted in an upside-down manner along the top portion of the wall member 2 (i.e. the top portion of the wall member 2 projects upwardly into the recess 16 of each foot 3, and the projection 23 of each foot 3 extends downwardly into the interior of the wall member 2. A shelf 32 is supported atop the feet 3 by the upwardly turned flat portions thereof, and is preferably secured thereto by means of a fastener 33 such as a dow peg or other fastener.

Further, it may be desirable to provide the bottom feet 3 shown in FIG. 6 with wheels or castors such as that shown in FIG. 4A.

In accordance with an alternative embodiment of the divider wall arrangement not shown here, it may be desirable to rigidly join the feet 3 to one another by means of an elongate support member extending therebetween to provide added stability to the divider wall arrangement.

Although particular preferred embodiments of the invention have been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. An upright, freestanding, portable divider wall arrangement comprising:

a wall member of a lightweight foam material and having a top portion, a bottom portion, first and second spaced-apart side surfaces which face away from one another and a solid interior portion of said foam material extending transversely between said side surfaces; and first and second feet disposed spaced-apart from one another along said bottom portion of said wall member to support said wall member in a generally upright manner, each said foot including an upwardly opening recess defined by two spaced-apart side walls and a bottom wall extending transversely between said side walls, and a cantilevered projection extending generally vertically upwardly from said bottom wall and being disposed in spaced relation between said side walls, said recess receiving therein said bottom portion of said wall member and said projection extending into, and being snugly engaged within, said solid interior portion to fasten the respective said foot to said bottom portion of said wall member.

2. The divider wall arrangement of claim 1 wherein said projection has a lower end disposed at said bottom wall of said recess and an upper end having a pointed configuration which extends in a self-penetrating manner into said solid interior portion.

3. The divider wall arrangement of claim 1 wherein said projection is disposed on said bottom wall at an approximately equal distance from each of said side walls of said recess.

4. The divider wall arrangement of claim 1 wherein each said foot comprises first and second end surfaces facing away from one another, said two side walls being generally parallel to one another and said bottom wall being generally perpendicular to and extending between said two side walls, said two side walls and said bottom wall extending transversely between and adjoining said first and second end surfaces.

5. The divider wall arrangement of claim 4 wherein said projection extends generally vertically upwardly from said bottom wall of said recess and generally parallel to said two side walls, said projection being spaced at an approximately equal distance from each of said side walls and being frictionally engaged within said solid interior portion of said wall member at said bottom portion thereof to fasten said foot to said wall member.

6. The divider wall arrangement of claim 1 wherein said first and second side surface are configured for displaying information thereon.

7. The divider wall arrangement of claim 1 wherein said wall member is constructed of rigid plastic foam.

8. The divider wall arrangement of claim 1 wherein said wall member comprises a monolithic one-piece slab of rigid plastic foam having a substantially uniform and minimum thickness of about three inches.

9. The divider wall arrangement of claim 1 wherein said first and second feet each include wheels mounted at a bottom portion thereof.

10. The divider wall arrangement of claim 1 wherein said projection when inserted into said solid interior portion causes deformation of said foam material to rigidly fasten the respective foot to said wall member.

11. The divider wall arrangement of claim 2 wherein said projection when inserted into said solid interior portion causes deformation of said foam material to rigidly fasten the respective foot to said wall member.

12. The divider wall arrangement of claim 1 wherein said projection has an upper end with a pointed shape which extends into said solid interior portion in a self-penetrating manner.

13. An upright, freestanding, portable divider wall arrangement comprising:

a wall member having a top portion and a bottom portion and comprising a lightweight foam material;

first and second feet disposed spaced-apart from one another along said bottom portion of said wall member to support said wall member in a generally upright manner, each said foot including means for removably fastening said foot to said bottom portion of said wall member; and third and fourth feet disposed spaced-apart from one another along said top portion of said wall member each including means for removably fastening the respective said foot to said top portion of said wall member, and shelf means disposed atop said third and fourth feet, said first, second, third and fourth feet being substantially identical to one another and said third and fourth feet being disposed in an inverted position with respect to said first and second feet.

14. An upright, freestanding, portable divider wall arrangement comprising:

a wall member constructed of a monolithic one-piece slab of lightweight foam material and having a top portion, a bottom portion, first and second spaced-apart side surfaces which face away from one another and a solid interior portion extending transversely between said first and second side surfaces, said wall member having a minimum thickness defined between said first and second side surfaces of about three inches; and first and second feet spaced-apart from one another along said bottom portion of said wall member to support said wall member in a generally upright manner, each said foot including an upwardly opening recess defined by two spaced-apart side walls and a bottom wall extending transversely between said side walls, and a cantilevered projection extending generally vertically upwardly from said bottom wall and being disposed in spaced relation between said side walls, said recess receiving therein said bottom portion of said wall member and said projection having a tapered upper end extending in a self-penetrating manner into said solid interior portion of said foam material to fasten the respective said foot to said bottom portion of said wall member.

15. The divider wall of claim 14 wherein said projection defines an outer surface having a substantial portion which directly engages said solid interior portion of said foam material.

* * * * *

UNITED STATES PATENT AND TRADEMARK OFFICE
CERTIFICATE OF CORRECTION

PATENT NO : 6 061 972
DATED : May 16, 2000
INVENTOR(S) : Clarkson S. THORP

It is certified that error appears in the above-identified patent and that said Letters Patent are hereby corrected as shown below:

Column 4; line 57, change "surface" to ---surfaces---.

Signed and Sealed this

Fifteenth Day of May, 2001

*Attest:*

Nicholas P. Godici

NICHOLAS P. GODICI

*Attesting Officer*

*Acting Director of the United States Patent and Trademark Office*